United States Patent [19]

Robinson et al.

[11] 4,003,181

[45] Jan. 18, 1977

[54] METHOD OF ERECTING A TENT STRUCTURE

[75] Inventors: Denis Wilson Robinson, Mercer Island, Wash.; George Benjamin Madison, Wichita, Kans.

[73] Assignee: The Coleman Company, Inc., Wichita, Kans.

[22] Filed: Dec. 22, 1975

[21] Appl. No.: 642,785

Related U.S. Application Data

[62] Division of Ser. No. 529,742, Dec. 5, 1974, Pat. No. 3,951,159.

[52] U.S. Cl. ..... 52/745; 135/3 E; 135/DIG. 12

[51] Int. Cl.[2] ..... E04G 21/12; E04G 21/14

[58] Field of Search ..... 135/1 R, 3 E; 52/745

[56] References Cited

UNITED STATES PATENTS

| | | | |
|---|---|---|---|
| 2,976,876 | 3/1961 | Lonngvst | 135/3 E |
| 3,168,101 | 2/1965 | Porter | 135/3 E X |
| 3,181,542 | 5/1965 | Bareis | 135/3 E X |
| 3,223,098 | 12/1965 | Dole, Jr. | 135/3 E X |
| 3,943,952 | 3/1976 | Marguart et al. | 135/3 E X |

*Primary Examiner*—Werner H. Schroeder
*Assistant Examiner*—Conrad L. Berman
*Attorney, Agent, or Firm*—Tilton, Fallon, Lungmus, Chestnut & Hill

[57] ABSTRACT

A tent structure includes a covering which has four upright triangular walls laid out in rectilinear relation to each other. A pair of transverse ridges are formed at the top of the tent covering. A rigid ridge pole assembly supports the covering along one of the ridges; and a flexible spreader bar assembly supports the covering along the other ridge. Four top/corner pieces of covering material are provided—one for each quadrant defined by the cross ridges. Each top/corner piece extends between adjacent ridge sections and between the inclined edges of adjacent ones of the triangular walls to complete the enclosure. The spreader bar assembly overlies and is carried by the rigid ridge pole assembly; and the tent covering is tensioned by lengthening upright support poles which support the rigid ridge pole assembly.

5 Claims, 14 Drawing Figures

Fig. 5
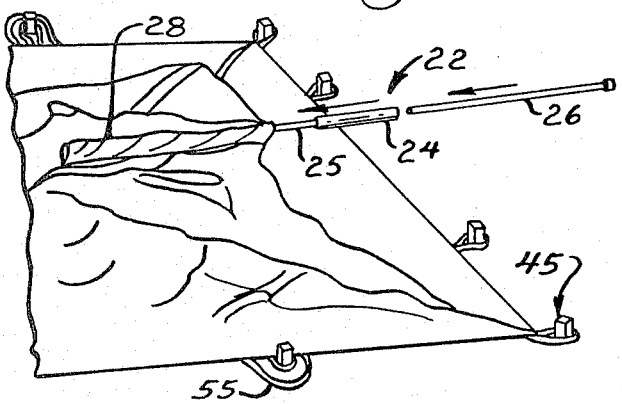
Fig 6
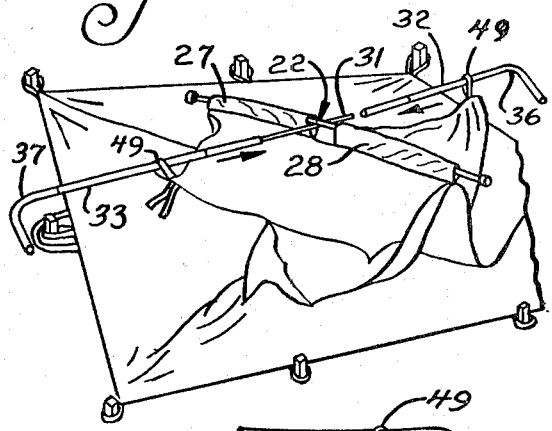
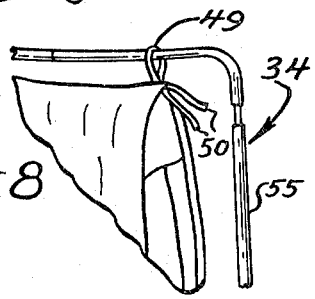
Fig. 8
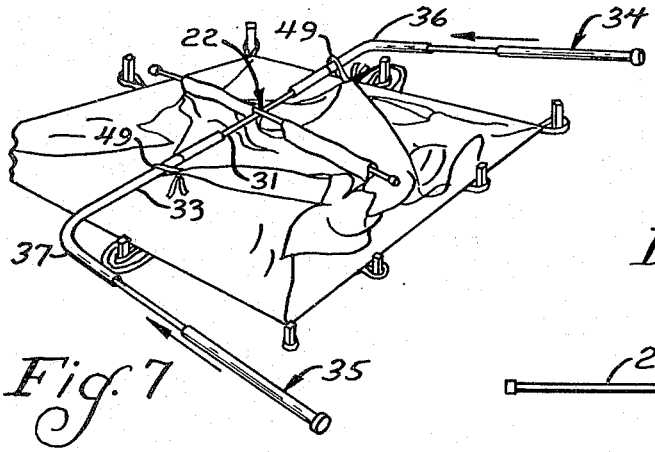
Fig. 7
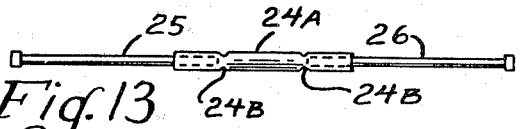
Fig. 13
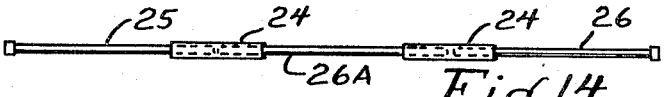
Fig. 14
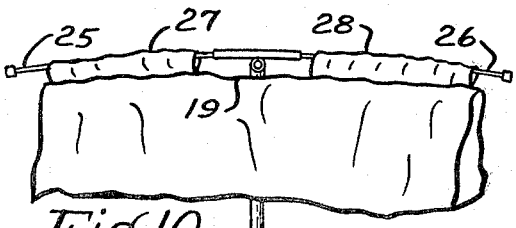
Fig. 10
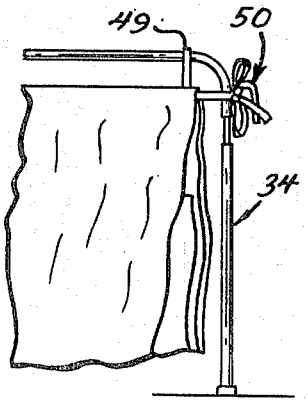
Fig. 9
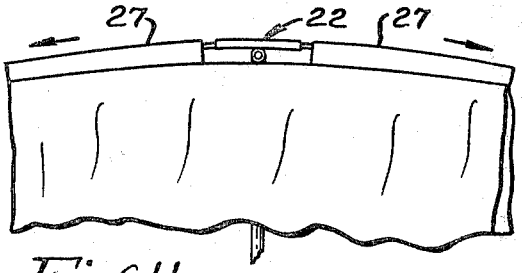
Fig. 11
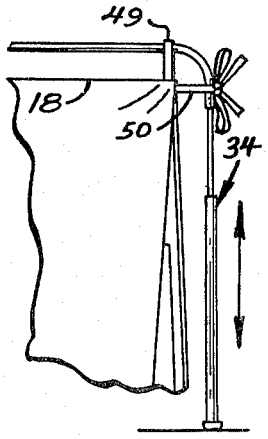
Fig. 12

METHOD OF ERECTING A TENT STRUCTURE

This is a Divisional Application of copending application Ser. No. 529,742, filed Dec. 5, 1974, now known as U.S. Pat. No. 3,951,159.

BACKGROUND AND SUMMARY

The present invention relates to a tent structure and a method of erecting a tent. Tents, of course, have long been known; and many different structures have been proposed for tents and are in commercial use.

One important use for tents, from a commercial standpoint, is that of a camper carrying his gear in or on a backpack. There is a desire, in this and other instances, to have a tent which is compact in the sense of having a minimum floor area and minimum height, while providing sufficient headroom. Further, it is desirable to reduce the number of poles or frame elements required to support the tent shell or covering.

In the present invention, a tent structure includes a covering which has four upright triangular walls laid out in the form of a square or rectangle. A pair of transverse ridges are formed in the top of the tent covering, each ridge extends between the upper corner of opposing triangular walls.

Four top/corner pieces of covering material are provided to cover the quadrants defined by the transverse ridges. Each top/corner piece extends between adjacent ridge sections and between the inclined edges of adjacent ones of the triangular walls to complete the enclosure. Thus, each top/corner piece takes the general form of a symmetrical four-edged kite which is inverted to form a groove extending from the central portion of the top of the shell down to a corner of the base.

The supporting structure includes a rigid ridge pole assembly which extends along one of the transverse ridges of the shell, and is supported at its ends by a pair of upright, telescoping support poles (sometimes simply called the "uprights"). The ridge pole may be of fixed length, and it extends through a pair of loops, one at each end of the first ridge. This first ridge is tensioned against the upright support poles by a pair of ties, one at each end.

The second ridge is supported by a flexible spreader bar assembly which in the case of a two-man or three-man tent, may be provided in three pieces, each end piece fitting through a sleeve extending along one of the side ridge sections of the second ridge. For larger tents, the spreader bar assembly may be made longer and include more sections and couplers. In either case, the center portion of the spreader bar assembly rests on top of the center portion of the rigid ridge pole. Thus, load is transmitted from the spreader bar assembly to the rigid ridge pole and thence to the ground by means of the upright support poles. The upright support poles are capable of being adjusted in fixed lengths by means of a spring pin secured to an inner telescoping section and extending through an aperture in the outer piece. This type of adjusting mechanism is known in the art.

To erect the tent, the upright support poles are adjusted to the shortest length. The ridge pole is assembled through the corner loops on the first ridge, and the flexible spreader bar is placed through the sleeves on the second ridge and crossing over the center portion of the ridge pole.

With the bottom of the tent staked, the upright support poles are placed in their vertical positions. Tie tapes are used to secure the outboard ends of the first ridge to the upright support poles to tension the shell along the first ridge. Further, the sleeves are stretched along the outboard ends of the spreader bar assembly. The entire shell is tensioned by elongating the upright support poles as they remain in their vertical positions.

The present invention thus provides for a compact tent structure with a minimum of floor space and height, while providing sufficient headroom. Further, the entire structure is compact when disassembled and occupies a minimum of space. Further, the structure may be simply and easily erected by a single person.

Other features and advantages will be apparent to persons skilled in the art from the following detailed description of a preferred embodiment, accompanied by the attached drawing wherein identical reference numerals will refer to like parts in the various views.

THE DRAWING

FIGS. 5–12 illustrate the method of erecting the tent shown in FIGS. 1–3;

FIG. 13 shows a spreader bar assembly for a three-man tent; and

FIG. 14 shows a spreader bar assembly for a four-man tent.

DETAILED DESCRIPTION

Figure 1:
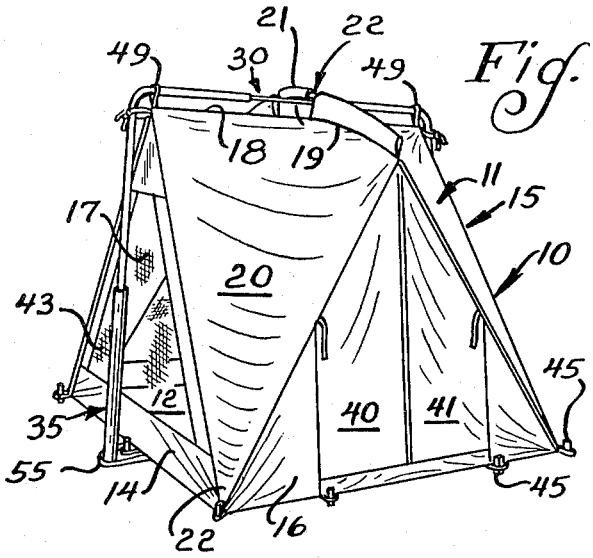
FIG. 1 is an upper perspective view of an erected tent structure incorporating the present invention.

Referring first to FIG. 1, reference numeral 10 generally designates a two-man tent structure including an upper covering or shell 11 and a bottom 12. The bottom 12 is assembled to the shell 11 by conventional means.

The covering 11 includes a first pair of opposing side walls 14, 15 and a second pair of opposing side walls 16, 17. Each of the side walls 14–17 is triangular in shape, and they are laid out in a rectilinear relation to each other—that is, either in the form of a square or a rectangle, a square being illustrated in the diagrammatic layout of FIG. 4.

The triangular upright walls 14, 15 are joined by a first ridge 18, and the other opposing pair of walls 16, 17 are joined by a second ridge 19 which is transverse to the ridge 18. Thus, the tent structure takes a generally A-frame configuration in each of two perpendicular directions, and it is therefore sometimes referred to as a "modified A-frame" structure.

The roof and sides are formed by four separate sections which are referred to as top/corner pieces, one of which is generally designated 20 in FIG. 1. Each top/corner piece extends between adjacent sides of the transverse ridges 18, 19 and between the edges of adjacent side walls. Thus, the top/corner piece 20 extends from the left side of the ridge 18 to the forward side of the ridge 19, and between the closest edges of the adjacent walls 14, 16. Further, it extends from the upper central portion of the tent designated 21 in FIG. 1 down to the corner 22 between the side walls 14, 16.

The top/corner piece 20 thus has the general shape of an inverted kite of four edges, being bowed between the top corners of adjacent triangular walls and forming a depression or run along its longer dimension. The top/corner piece 20 is not exactly symmetrical because, as will be appreciated from further description, the side wall 14 extends slightly higher than the side wall 16 and the ridge 18 is more truly horizontal, whereas the ridge 19 is slightly bowed since it is held by a centrally-supported flexible spreader bar assembly, generally designated by reference numeral 22.

For tents of larger sizes, the spreader bar assembly is made longer, as will be discussed. Hence, for the larger sizes, the top/corner pieces are even less symmetrical, although the depression mentioned above still exists.

Figure 3:
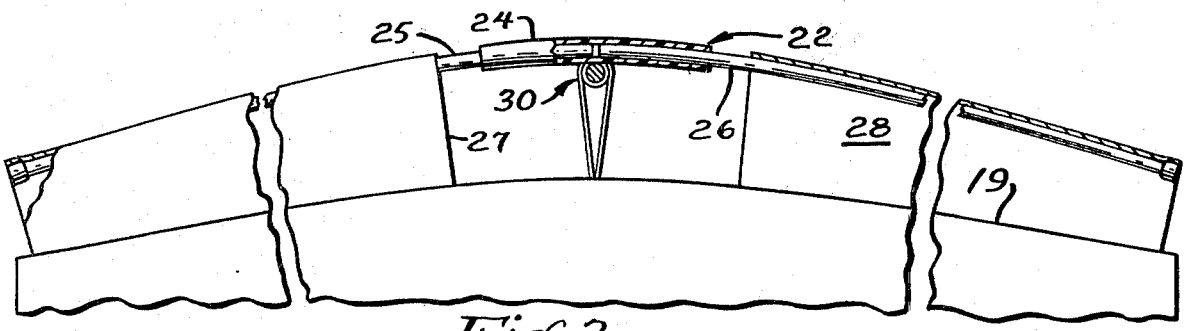
FIG. 3 is a fragmentary vertical cross-sectional view, again with portions broken away, of the structure of FIG. 1, taken parallel to the spreader bar assembly and perpendicular to the plane of the page of FIG. 2.

The spreader bar assembly 22 for the two-man tent is best illustrated in FIG. 3 as including a central coupler tube 24 and first and second side flexible rods 25, 26 which are received and held by the coupler tube 24, acting to form sockets for the inboard ends of the rods.

The flexible rods 25, 26 are received respectively in sleeves 27, 28 (the sleeve 28 being shown in FIG. 3 in cross-sectional view). The sleeves 27, 28 are sewn respectively along the side sections of the ridge 19.

The spreader bar assembly 22 is supported at its center by a rigid ridge pole assembly designated 30. The central portion of the coupler tube 24 merely rests on the central portion of the rigid ridge pole assembly 30.

Figure 2:
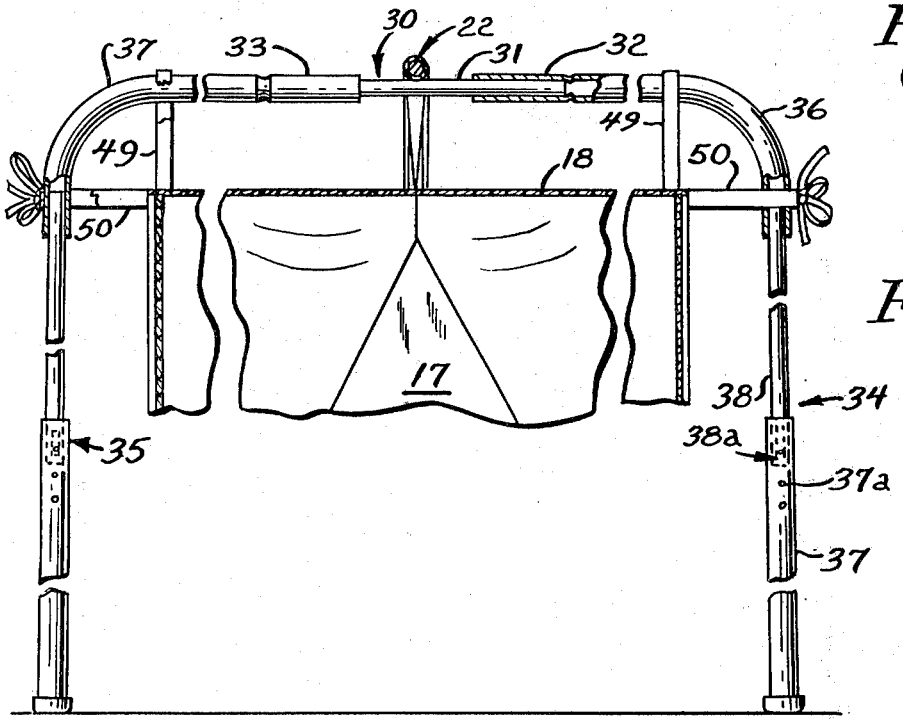
FIG. 2 is a vertical cross-sectional view, with portions broken away, of the structure of FIG. 1, taken in a plane parallel to the rigid ridge pole.

Referring to FIG. 2, the ridge pole assembly includes a central tube 31 of reduced diameter, and first and second tubular end members 32, 33 which receive and support the smaller central tube 31. The tubes 32, 33 include downwardly extending elbows 36, 37 which receive the upper ends respectively of extensible upright support poles 34, 35.

Each of the upright support poles 34, 35 is a multipiece telescoping assembly. For example, the support pole 34 includes a lower piece 37 and an upper piece 38 of smaller diameter. The downwardly extending end of the elbow 36 snugly receives the upper open end of the top section 38.

Adjacent sections of the upright support poles 34, 35 may be adjusted in fixed increments by means of depression spring assemblies of a type known in the art. In this type of adjustment mechanism, the larger tube section is provided with a set of holes 37*a* which are spaced along its axis, and the smaller tube section (which is telescopically received in the larger tube section) is provided with a spring-held pin 38*a* extending outwardly and receivable in one of the apertures. When the pin is depressed, the two tubes may be moved axially of each other to either extend or retract the same until the pin is fitted into another aperture.

The triangular vertical wall 16 of the tent may be provided with a center-opening door, including portions 40, 41 in FIG. 1. It will be observed that the door of the tent is provided preferably on a side where there is no vertical support pole—that is, the peak of the door is held up by the spreader bar assembly 22. As seen in the illustration, netting such as that shown at 43 may be provided on the other three sides, if desired, to let in light and air. As best illustrated in FIGS. 2, 8, 9, and 12, the tent is provided with a tape loop 49 and a pair of tie tapes 50 adjacent each corner of the ridge 18 beneath the ridge pole assembly 30. The purpose of these elements will be made clear below. Further, a pair of bottom loops are provided at 55 for holding the bottoms of the uprights.

The spreader bar assembly for the two-man tent, as seen in FIG. 3 has the inboard ends of the rods 25, 26 close to one another toward the center of the coupler tube 22. For a three-man tent, the coupler tube 24A (FIG. 13) is longer and has two peripheral grooves 24B for limiting insertion of the rods 25, 26. For a still larger tent, the spreader bar assembly has two coupler tubes 24 (FIG. 14) and three flexible rods 25, 26 and 26A. The tent, of course, is proportioned accordingly.

METHOD OF ERECTING TENT

Figure 4:
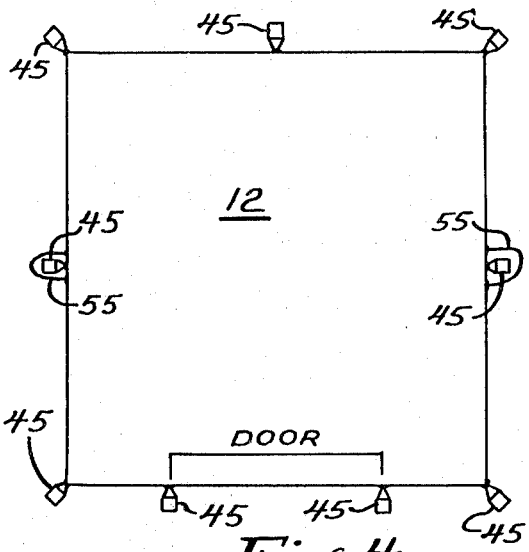
FIG. 4 is a diagrammatic view illustrating the placement of stakes for the bottom of the tent of FIG. 1.

Referring to FIG. 4, the bottom 12 of the tent is secured to the ground by means of stakes extending through loops provided at the positions designated 45 on the tent bottom. It will be observed that there is a stake at each corner, a stake at the middle of each of the walls 14, 15, and 17, and a stake at each side of the door in the wall 16. Many types of stakes or equivalents are known for securing a tent bottom to the ground, and the present invention is not limited to any particular type.

Referring now to FIG. 5, the spreader bar assembly 22 is put together by inserting the flexible rods 25, 26 into the coupler tube 24, and the spreader bar assembly is then inserted in the sleeves 27, 28 such that the flexible rod 25 is within the sleeve 27 and the flexible rod 26 is in the sleeve 28.

The rigid ridge pole assembly 30 is put together by inserting the central tube 31 in the end tubes 32, 33. The ridge pole assembly is then inserted through the tape loops 49 located at the outboard corners of the ridge 18 of the tent shell, and the ridge pole assembly is also located beneath the spreader bar assembly 22, as seen in FIGS. 6 and 7.

It is not important that the sequence just described be followed. That is to say, the ridge assembly 30 could first be inserted through the tape loops 49, and the spreader bar assembly 22 could thereafter be slipped through the sleeves 27, 28 and above the ridge assembly.

Turning now to FIG. 7, with the telescoping upright support pole assemblies 34, 35 adjusted to the shortest length possible, the upper portions are coupled to the elbows 36, 37 of the ridge assembly, as illustrated by the directional arrows in FIG. 7. This can be accomplished with the other upright support pole assembled to its associated elbow, or not since the ridge assembly permits twisting. The upright support pole may be elevated with the other upright support pole held by another person, as would be the case for the illustration of FIG. 8, but this is not necessary. Obviously, both upright support poles could be elevated simultaneously, if desired. At this time, however, the upright support poles are in their shortest extensions. The bottoms of the upright support poles 34, 35 are placed within the loops 55, as illustrated in FIG. 1 for the pole 35.

With the upright support pole in the elevated position, the tape ties 50 are then secured about it by tying as illustrated in FIG. 9.

With both upright support poles elevated, and with the tent material still untensioned as seen in FIG. 10, the sleeves 27, 28 are stretched out lengthwise over the flexible rods 25, 26, as illustrated in FIG. 11 by the directional arrows.

With the ridge 18 drawn taut by the tie tapes 50 and the sleeves 27, 28 drawn over the spreader bar assembly, the tent body is stretched taut by extending the upright support poles vertically, as illustrated in FIG. 12.

Having thus described in detail a preferred embodiment of the tent structure and the method of erecting it, persons skilled in the art will be able to substitute equivalent elements for those which have been shown or to modify the erection procedure while continuing to practice the principle of the invention; and it is, therefore, intended that all such modifications and substitutions be covered as they are embraced within the spirit and scope of the appended claims.

We claim:

1. In a method of erecting a tent having a bottom secured to the ground and a shell defining first and second intersecting ridges, each ridge extending between opposing upright side walls, the steps comprising: inserting a rigid ridge support through flexible connector means along said first ridge; inserting a flexible ridge support through flexible connector means along said second ridge; said steps of inserting further including interconnecting said rigid ridge support with said flexible ridge support such that said flexible ridge support is carried by said rigid ridge support, each of said ridge supports extending substantially the entire length of its associated ridge; inserting an upright extensible support between the ground and each of said rigid ridge support, the length of each of said extensible supports being adjusted sufficient to support said rigid ridge support above the ground while not stretching taut said tent material; and then extending said extensible supports to stretch said tent taut.

2. The method of claim 1 further comprising the step of tensioning said first ridge of said shell against said first and second extensible upright supports.

3. A method of erecting a tent having a bottom and a shell defining first and second intersecting ridges comprising: securing said tent bottom to the ground about its periphery; loosely assemblying a rigid ridge pole and a flexible ridge pole to first and second respective connector means located respectively along said first and second ridges such that said flexible ridge pole overlies said rigid ridge pole; assembling first and second support poles to the ends of said rigid ridge pole; and raising said support poles to their upright positions to thereby raise said shell by carrying said shell with said ridge poles along said ridges.

4. The method of claim 3 further comprising the steps of tying the ends of said first ridge to said support pole to thereby tension said tent along said first ridge; and pulling said second connector means outwardly along said flexible ridge pole to thereby tension said tent along said second ridge.

5. The method of claim 4 further comprising the step of elongating said support poles vertically to apply tension to said shell before said step of pulling said second connector means along said flexible ridge pole.

* * * * *